US010401036B2

(12) United States Patent
Faraldi et al.

(10) Patent No.: US 10,401,036 B2
(45) Date of Patent: Sep. 3, 2019

(54) HUMIDITY FLUSHING SYSTEM

(71) Applicant: Electrolux Appliances Aktiebolag, Stockholm (SE)

(72) Inventors: Paolo Faraldi, Forli (IT); Lorenzo Gattei, Forli (IT); Nicola Guida, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 178 days.

(21) Appl. No.: 15/523,788

(22) PCT Filed: Nov. 17, 2015

(86) PCT No.: PCT/EP2015/076738
§ 371 (c)(1),
(2) Date: May 2, 2017

(87) PCT Pub. No.: WO2016/087180
PCT Pub. Date: Jun. 9, 2016

(65) Prior Publication Data

US 2017/0321904 A1 Nov. 9, 2017

(30) Foreign Application Priority Data

Dec. 1, 2014 (EP) ..... 14195551

(51) Int. Cl.
*F24C 15/20* (2006.01)

(52) U.S. Cl.
CPC ..... *F24C 15/2007* (2013.01)

(58) Field of Classification Search
CPC ..... F24C 15/2007
(Continued)

(56) References Cited

U.S. PATENT DOCUMENTS 5,525,782 A * 6/1996 Yoneno ..... A21B 3/04 219/401
6,987,246 B2 * 1/2006 Hansen ..... A21B 3/04 126/20
2011/0278279 A1 * 11/2011 Giazzon ..... F24C 15/327 219/400

FOREIGN PATENT DOCUMENTS

DE 4324507 A1 1/1995
DE 202004015285 U1 2/2006
(Continued)

OTHER PUBLICATIONS

International Search Report and Written Opinion issued in corresponding application No. PCT/EP2015/076738 dated Jan. 18, 2016, 10 pages.

*Primary Examiner* — Avinash A Savani
(74) *Attorney, Agent, or Firm* — Pearne & Gordon LLP

(57) ABSTRACT

A kitchen appliance (1) comprising at least one first fan (15) and a cavity 82), wherein said cavity (2) comprises at least one outlet opening (3) for exhaustion of vapor and/or steam out of the cavity (2) into a first duct (4), wherein said first duct (4) can be opened or closed by a first valve (5), and at least one inlet opening (6) for influx of air into the cavity (2) from a second duct (7), wherein said second duct (7) can be opened or closed by a second valve (8), wherein said first duct (4), particularly said first valve (5), is configured such that in an open stage of said first valve (5) said exhaustion of vapor and/or steam out of at least one outlet opening (3) of the cavity (2) into said first duct (4) is substantially due to an overpressure of vapor and/or steam within said cavity (2), and wherein said second duct (7), particularly said second valve (8), is configured such that in an open state of said second valve (8) said influx of air into at least one inlet opening (6) of the cavity (2) from said second duct (7) is substantially due to an overpressure of said air generated in
(Continued)

said second duct (7), preferably by said at least one first fan (15).

21 Claims, 5 Drawing Sheets

(58) Field of Classification Search
USPC ..... 126/21 A, 20
See application file for complete search history.

(56) References Cited

FOREIGN PATENT DOCUMENTS

| | | | |
|---|---|---|---|
| DE | 202011051026 | U1 | 10/2011 |
| EP | 0319673 | A1 | 6/1989 |
| EP | 1215444 | A1 | 6/2002 |

* cited by examiner

HUMIDITY FLUSHING SYSTEM

The present invention relates to a kitchen appliance, preferably a steam oven.

In kitchen appliances, for example ovens, and particularly steam ovens, in which steam and/or vapor accumulates within a cavity during a cooking cycle, said steam and/or vapor usually is produced during cooking cycles either by a dedicated steam or vapor generator or by the cooking of the food stuff as such.

However, a user opening the frontal door of such kitchen appliance, which usually closes a cooking compartment, for example a cavity, is exposed to said vapor and/or steam contained within the cavity upon opening said door.

Particularly in build-in kitchen appliances, there is a tendency to arrange such kitchen appliances in under bench position, particularly under the cooking hob. Accordingly, steam and/or vapor exhausting the door being opened approaches an upper body part, particularly the head, of the user.

Therefore, the door opening at the end of a steam cooking cycle can be an unpleasant experience, as the upper body part, particularly a user's head, is exposed to a hot steam cloud.

However, also the kitchen appliance as such suffers from such steam and/or vapor exhausting the cavity upon door opening in a rather uncontrolled manner. This is, as by opening the door a concentrated steam cloud may directly condense on the kitchen appliance or parts thereof, and particularly on electrics or a control panel, the function of which may thus be affected. Particularly, user interfaces and, more particularly touch versions thereof, may thus malfunction upon such steam and/or vapor exposure, particularly upon repeated steam and/or vapor exposure.

In particular, with regard to steam ovens it is extremely important to keep steam and vapor inside the cooking compartment to ensure performances and energy consumption and to evacuate the steam and/or vapor from the oven cavity at the end of a cooking phase or when a door is to be opened.

For this purpose, it is known to provide a throttle valve on the cavity fumes exhaust. A variable output section of such exhaust itself may allow saturating better the oven cavity with steam during cooking operation by reducing the outflow, while it may provide a better drain of steam when needed, namely, just before a cooking cycle ends. However, this approach is efficient only in removing the excess of steam resulting from an overpressure.

In the prior art cavity overpressure fumes elimination is typically performed by a forced ventilation system, particularly the one used in built-in kitchen appliances for cooling the external surfaces, in which, by the help of a fan fumes are drained out of the cooking compartment and mixed with an air flow before being expelled.

It is known that a typical cooking cycle basically consists of three phases, i.e. a heat up phase, where steam is inserted into an oven cavity to reach a temperature setting and guarantee cooking performance and energy consumption; followed by a cooking phase, where steam is preserved within the oven cavity to guarantee cooking performance and energy consumption; and, especially for steam ovens running a steam cooking cycle, a desteaming phase, where steam within the oven cavity is release, basically by taking advantage of a steam excess within the cavity.

Steam evacuation performances, though, are limited, as the cavity, besides the central opening closable by a door, has one exhaust duct as its only opening. Particularly, if configured as a closed system, the only driving force to push fumes and steam excess out of the exhaust is an overpressure existing in the cooking compartment. It is known to enhance such overpressure by a limited extra-heating of the oven cavity, particularly upon a desteaming operation.

In domestic ovens the hot steam cloud released upon door opening, however, is still a known constraint which represents a safety risk for users, at least an unpleasant discomfort, and, moreover, a potential damage source for the kitchen appliance itself.

The existing desteaming technologies only partially and insufficiently overcome the above-described constraints. For example, increasing the exhaust's dimension has as key limitation the energy consumption performance, which would be negatively affected.

The document EP 0 319 673 A1 describes a device for controlling a cooking appliance, which is operated by steam entering a cooking chamber, which cooking chamber has an opening for the escape of steam located in the oven ceiling, a return line through which the escaping steam is led into the under-pressure region of a blower, where it is mixed with the remaining cooling air drawn by the blower from a pressure duct. The steam is discharged via an air duct, characterized in that the return line can be connected to the cooking chamber via a sealable steam escape opening and the air duct can be connected to the cooking chamber via a sealable air feed opening. However, the device described in this document basically uses a venturi effect within said return line for the steam exhaustion. Thereby, such appliance still has the problem that the oven cavity is not sufficiently freed from steam upon opening of the door.

Moreover, a person skilled in the art will immediately acknowledge that such system according to the prior art is dependent on said venturi effect, and thus particularly works only in a certain set of combinations of opening diameters, duct geometry and local flow speeds. More particularly, a suction of steam and/or vapor out of the cavity, particularly on the openings in an upper cavity wall, will be created by said venturi effect only with a particular shape of the channel allowing distinct local flow speeds that are significantly different. Similarly, an overpressure will drive flow in the same direction in all of said openings.

It is an object of the present invention to overcome the above-mentioned constraints.

It is a further object of the present invention to provide a kitchen appliance where steam and/or vapor contained within a cavity is prevented from unwanted escape out of the cavity, particularly out of a door for closing the cavity, and more particularly, at the end of a cooking cycle and/or when a door is to be opened. It is a still further object of the present invention to provide a kitchen appliance where steam and/vapor is exhausted in a controlled manner such that upon an opening of the door no or a tolerable reduced amount of steam and/or vapor exhausts through the opened door.

It is a still further object of the present invention to provide a cavity exhaustion system with a more easy design and, particularly independent of a venturi effect.

A kitchen appliance according to a disclosed embodiment comprises

- at least one first fan and
- a cavity, wherein said cavity comprises
- at least one outlet opening for exhaustion of vapor and/or steam out of the cavity into a first duct,
- wherein said first duct can be opened or closed by a first valve, and at least one inlet opening for influx of air into the cavity from a second duct, wherein said second duct can be opened or closed by a second valve, wherein said first duct, particularly said first valve, is configured such that in an open stage of said first valve said exhaustion of vapor and/or steam out of at least one outlet opening of the cavity into said first duct is substantially due to an overpressure of vapor and/or steam within said cavity, and wherein said second duct, particularly said second valve, is configured such that in an open state of said second valve said influx of air into at least one inlet opening of the cavity from said second duct is substantially due to an overpressure of said air generated in said second duct, preferably by said at least one first fan.

Such kitchen appliance advantageously provides an enhanced steam exhaust system to ensure an improved steam evacuation from the oven cavity. A more effective removal/reduction of the steam and/or vapor contained within the cavity during a cooking cycle is enhanced and an exhaustion of the vapor and/or steam through a door upon door opening is reduced. Moreover, steam and/or vapor can more effectively be drained and exhausted from the appliance cavity, particularly when vapor and/or steam is in excess for the running cooking cycle.

The advantageous effect of the present invention is particularly achieved in that at least one inlet opening is provided for an influx of air, preferably fresh air, more preferably relatively dry and/or cold fresh air, into the cavity from said second duct. It is important to understand that said second duct, which preferably serves as a cold air channel, is adopted to put air, preferably fresh air, more preferably relatively dry and/or cold fresh air, into the cavity through said at least one inlet opening, thereby preferably exploiting and/or generating an at least slight overpressure within the oven cavity. Said influx of air into the cavity through said at least one inlet opening of the cavity is substantially due to an overpressure of said air in said second duct, generated by at least one first fan, preferably a ventilation fan.

A person skilled in the art will immediately understand that the present invention is of particular advantage in that a first fan, particularly if a single fan is applied as a first fan, is configured such that it is capable of driving and/or generating an oven cooling flow. Preferably, a main cooling fan of the kitchen appliance is used as the first fan. Particularly said cooling flow may be capable of evacuating over pressure from the cavity, particularly through the outlet opening, and may also create an over pressure to drive flushing air into the cavity, particularly through the inlet upon need.

However, it is to be understood that the exhaustion of vapor and/or steam out of the cavity into a first duct is mainly driven by an overpressure of steam and/or vapor within the cavity.

According to the invention an influx of air into the cavity from a second duct is mainly due to an overpressure of air in said second duct generated by such at least one first fan. In other words, such at least one first fan is capable of exhibiting a driving force for influx of fresh air into the cavity by an overpressure generated by said fan.

Said second duct can be opened or closed by a second valve, which may be opened or closed, preferably coordinated with said first valve, which is for opening or closing at least one outlet opening for exhaustion of vapor and/or steam out of the cavity into said first duct. Said first duct can be opened or closed by a first valve, which may be opened or closed, preferably coordinated with said second valve, which is for opening or closing at least one inlet opening and said second duct for influx of air into the cavity.

The inlet opening and, preferably the second duct, may serve as a cold air opening and/or channel, respectively.

The second valve can be advantageously operated along with and/or coordinated with the first valve, to achieve a washing effect such that, preferably steam and/or vapor within the cavity exhausts out of the outlet opening and is replaced and/or displaced by air, which enters the cavity by an air influx into the cavity from the second duct. Thus, the steam and/or vapor within the cavity is replaced and/or displaced. Such washing and/or flushing preferably is mainly due to a psychrometric effect, by injecting a, preferably relatively small quantity of, influx air, preferably fresh air, more preferably relatively dry and/or cold fresh air, preferably ambient air. A person skilled in the art will immediately understand that this will affect air title inside the cavity with a limited impact on temperature of the air and/or steam within the oven cavity. In connection therewith, it is to be understood that a more massive flushing flow may abate oven temperature, wasting at the same time energy, as a desired temperature may have to be recovered.

The present inventors have surprisingly found that by said arrangement of the first valve controlling the first duct and the second valve controlling the second duct, and more particularly by the influx of air into the cavity from a second duct, a relatively small amount of air, preferably relatively dry air, is sufficient to absorb a significant amount of humidity, as the overall humidity of the air, vapor and/steam within the cavity is reduced.

The cooking appliance according to the present invention thus allows for a cooking cycle which preferably has four phases, i.e. a heat up phase, where steam and/or vapor is generated within or inserted into the oven cavity to reach a desired temperature setting and to guarantee cooking performance and energy consumption; second, a cooking phase, where steam and/or vapor is preserved within the cavity to guarantee cooking performance and energy consumption; third, a desteaming phase, where the vapor and/or steam contained within the cavity having an overpressure is released and, fourth a cavity flushing phase, where the cavity steam excess is released, more particularly where a washing effect is achieved such that, preferably steam and/or vapor within the cavity exhausts out of the outlet opening and is replaced and/or displaced by air, which enters the cavity by an air influx into the cavity from the second duct through the inlet opening. Thus, the steam and/or vapor within the cavity is advantageously replaced and/or displaced by air entering the cavity through the inlet opening from the second duct.

This is of additional and particular advantage in that the requirement for a sudden humidity reduction, e.g. during a cooking cycle, for example during the roasting of meat, when, for example, a surface browning of the meat should happen, or the baking of bread where the humidity is to be reduced after an initial high humidity phase, a short cavity washing, i.e. a steam and/or vapor replacement and/or displacement, can be performed to reach a desired humidity level within the oven cavity.

It is to be understood that such cavity washing is particularly performed when the second valve is operated along with the first valve, such that steam and/or vapor within the cavity exhausts out of the outlet opening out of the cavity into a first duct, wherein a first valve is in an opened state, and said steam and/or vapor is replaced and/or displaced by air, preferably generating an overpressure within the cavity upon air influx through the inlet opening, which supports the exhaustion of steam and/or vapor out of the outlet opening.

By entering of the air into the cavity by an air influx into the cavity from the second duct, steam and/or vapor within the cavity exhausts out of the outlet opening out of the cavity into a first duct. This particularly is possible, when said second valve is in an open state and thus the second duct is open for the air stream into the cavity. The steam and/or vapor within the cavity is advantageously replaced and/or displaced by the air streaming into the cavity through the inlet opening.

It will be immediately understood by a person skilled in the art that the kitchen appliance according to the present invention is more effective in exhausting the steam and/or vapor cloud out of the cavity in a controlled manner, leading to a reduced steam and/or vapor cloud leaking out of the cavity when the oven door is opened, particularly at the end of a cooking cycle.

Advantageously, a quick and effective humidity reduction in the cavity is possible, improving the performance of cooking functions needing very different humidity levels at different stages or for food generating significant amount of humidity themselves.

Accordingly, a system and, particularly a kitchen appliance according to the present invention provides active humidity reduction in the cavity, overcoming the limitation of a single, and more passive, output layout as known from the prior art. Thereby, the usability of the system and the user comfort and safety is significantly improved and, moreover, cooking performance capabilities are extended.

In connection with the kitchen appliance according to the present invention it is important to understand that the air introduced into the oven cavity through the at least one inlet opening for influx of said air into the cavity from a second duct, wherein said second duct is opened by a second valve being in an opened state, mainly performs two actions:

At first, upon opening of the first valve, allowing release of steam induced overpressure, the steam and/or vapor amount inside the cavity is reduced, resulting in a reduction of the humidity value; at second, the capability of the exhaust system to evacuate such fumes is supported by increasing the mass flow rate driven by the cooling system, particularly where a fan, preferably a radial fan is applied.

Advantageously, the second valve and the duct and/or channel design according to the present invention allows to maintain the system functioning as known in connection with appliances of the prior art during standard cooking phases, preferably not negatively affecting in a significant way the energy consumption performances of the oven.

A second duct according to the present invention preferably is configured as a small diameter pipe, more preferably capable of spilling a modest airflow form a high-pressure region of the at least one first fan, particularly e.g. from a radial cooling fan cochlea. Advantageously, a second fan, e.g. an auxiliary small fan, may be provided, preferably to support airflow into said second duct. The diameter of said second duct preferably is relatively small, more preferably no major components affect the overall oven thermal mass or fluid dynamic inside and outside of the cavity.

In an advantageous embodiment of the inventive kitchen appliance said kitchen appliance comprises a cooling system, preferably comprising a cooling chamber, and wherein the first duct is in fluid communication with the cooling system, preferably the cooling chamber.

Such configuration, wherein the first duct is in fluid communication with the cooling system, preferably with the cooling chamber, is advantageous as the at least one outlet opening is for exhaustion of vapor and/or steam out of the cavity into a first duct and thus may directly lead the vapor and/or steam into the cooling system, preferably directly into the cooling chamber. It will be immediately understood that whether or not vapor and/or steam is exhausted out of the cavity through the first duct directly into the cooling system, preferably directly into the cooling chamber, depends on whether the first duct is opened or closed by the first valve being either in a closed or opened state.

It is to be understood that the terms "opened" or "open state" as used herein in connection with a valve or valve state preferably may comprise also intermediate opening states of such valve, preferably being a regulation valve and/or throttle valve. In other words, a valve may be adjusted and/or regulated to be in a closed, or at least one open state, the open state comprising a full open state and at least one intermediate open state, e.g. a full open and a partially open state. Accordingly, a valve can be in a closed state or in any open state, comprising e.g. half-opened or full-opened state, which allows regulation of the inlet or outlet through such valve. Such intermediate opening positions are of particular advantage in connection with a first valve. However, also a second valve may be adjusted and/or regulated to be in a closed, or at least one open state, the open state comprising a full open state and at least one intermediate open state, e.g. a full open and a partially open state, and intermediate opening positions. The second valve and/or the first valve may be configured as a regulation and/or throttle valve. Accordingly, a first duct can be opened or partially opened, partially closed or completely closed by such a first valve. Accordingly, a second duct can be opened or partially opened, partially closed or completely closed by such a second valve.

In a further advantageous embodiment of the inventive kitchen appliance, the kitchen appliance comprises a cooling system, preferably comprising a cooling chamber, and wherein the second duct is in fluid communication with the cooling system, preferably the cooling chamber.

Such configuration, wherein the second duct is in fluid communication with the cooling system, preferably with the cooling chamber, is advantageous as the at least one inlet opening allows an influx of air into the cavity from said second duct.

Thus, air from the cooling system, preferably the cooling chamber may directly be introduced into the second duct and through the inlet opening into the cavity. It will be immediately understood that whether or not air from the cooling system, preferably from the cooling chamber, is introduced into the cavity through the second duct depends on whether the second duct is opened or closed by the second valve being either in a closed or opened state. However, an influx of air into the cavity from said second duct preferably causes an overpressure within the cavity, which is also advantageous in exhaustion of vapor and/or steam out of the cavity through the outlet opening into the first duct.

In a further advantageous embodiment of the inventive kitchen appliance, the first valve and/or the second valve is a throttle valve.

Such throttle valve is of advantage in that a restriction and narrowing of the flux is adjustable by said valve. Due to the thus elevated flow resistance, the volume flow is changed depending on the pressure gradient or pressure drop present at the valve. Such throttle valve may represent a flow control valve regulating the flow or pressure of a fluid, here the exhausting steam or the air influx, respectively. Such control valve normally responds to signals generated by independent devices such as flow meters, temperature gauges, or humidity sensors, which may be advantageously applied in the kitchen appliance according to the present invention.

In a further advantageous embodiment of the inventive kitchen appliance, the cavity and the cooling system are configured as an open system. An "open system" as used herein preferably refers to a system, substantially free of recirculation from/to the cavity environment. In other words, preferably no or no substantial recirculation happens from and/or to the cavity environment.

In connection therewith, it is to be understood that the second valve is preferably operated or operatable along with or coordinated with the first valve, particularly to achieve a "washing" effect of the cavity. Such "washing" effect may be advantageously achieved by a relatively small amount of relatively dry air introduced in the cavity, particularly through the at least one inlet opening. Such a relatively small amount of relatively dry air into the cavity can absorb a significant amount of humidity, as it may reduce the overall humidity title of the air in the cavity; furthermore, the appliance according to the present invention, particularly the cavity, is preferably not designed as a strictly closed system, whereby a significant flow out of the exhaust, i.e. the first valve, can be achieved.

Preferably, an overpressure is generated in the second duct, particularly in an area of the second valve and/or where the second valve input spills the air to be driven into the cavity. Such overpressure area may be located close to a high-pressure area of the first and/or second fan, e.g. the high-pressure area of a cooling radial fan cochlea, and/or at a second end of the second duct.

Preferably, the second duct, more preferably serving as a cold air channel, has a significantly smaller diameter section compared to the first duct.

An overpressure and/or said smaller diameter section of said second duct advantageously ensures that no or no significant backflow of air and/or steam and/or vapor into the second duct, and particularly into a cooling chamber occurs through said second duct.

A fan, particularly a radial fan comprises a suction area near its axis of rotation, and preferably a cochlea surrounding said fan, delimiting the air output section of said fan. Within such cochlea, the pressure usually is higher and can be exploited for driving relatively small flow, particularly compared with the main output flow.

In a further advantageous embodiment of the kitchen appliance according to the present invention said kitchen appliance comprises at least one second fan.

Such second fan advantageously may be configured and/or positioned such that it generates and/or supports an overpressure of air in a second duct.

Preferably, said influx of air into at least one inlet opening of the cavity from said second duct is substantially due to an overpressure of said air generated in said second duct, preferably by said at least one first fan and/or said at least one second fan.

Preferably, such second fan may alternatively or additionally generate and/or assist the at least one first fan in generating an overpressure of said air, particularly said influx of air into at least one inlet opening of the cavity from said second duct.

In an embodiment said second duct, particularly said second valve, is configured such that in an open state of said second valve said influx of air into at least one inlet opening of the cavity from said second duct is substantially due to an overpressure of said air generated in said second duct, preferably by said at least one second fan.

In a further embodiment of the appliance according to the present invention the at least one second fan is positioned close to or at a second end of the second duct.

In connection with providing such second fan in addition to the at least one first fan, it is to be understood that said second fan is provided additionally to the at least one first fan The at least one first fan may fulfill primarily the function of a main cooling fan, whereby the at least one second fan is configured and/or positioned such that the influx of air into at least one inlet opening of the cavity from said second duct is advantageously supported by said at least one second fan.

Preferably, a second fan according to the present invention is arranged in fluid communication with the second duct. In an embodiment, the second fan is arranged such that it is capable of generating an overpressure in the second duct, preferably alternatively or additionally to the overpressure generated by the first fan. In an embodiment, such second fan may be positioned in or connected to the second duct. Preferably, the second fan is arranged in front of the second valve with regard to the desired flow direction in the second duct.

Such second fan may advantageously generate an overpressure in the second duct, preferably supporting the first fan in generating an overpressure in said second duct. Preferably, said second fan is arranged such that it is capable of generating an additional flow in the second duct, e.g. on an external side of the cochlea of a main cooling fan. Preferably, the second fan is arranged and/or positioned in direct connection with the second duct.

Such second fan may advantageously enhance the flushing effect. Furthermore, such second fan advantageously prevents an undesired backflow of steam and/or vapor into the second duct and/or fluid dynamic short circuits.

Preferably, such second fan is configured smaller than a first fan.

Such smaller configuration is advantageous as it may be easily arranged and/or placed within the flushing system according to the present invention, preferably close to or as part of the second duct, more preferably at a second end of the second duct. It is to be understood that such second fan may be configured smaller compared to the first fan, as the main purpose of said first fan may still be to provide a cooling function, whereas such second fan may be provided for the sole purpose of generating and/or supporting an overpressure in the second duct.

In a further advantageous embodiment of the inventive kitchen appliance, the first valve and/or the second valve is an electric valve.

This particularly allows for a targeted and selective control of different valve states, e.g. opened or closed, particularly by m an oven control unit. Such electronic valve is also advantageous in ensuring a proper opening/closing of the valves and/or and thus the regulation of airflow through the respective first duct or second duct, respectively.

Thus, particularly where the kitchen appliance comprises a cooling system, preferably comprising a cooling chamber and wherein the second duct is in fluid communication with the cooling system, preferably the cooling chamber an influx of fresh air coming from the cooling system, preferably from the cooling chamber, may be advantageously regulated, and an overpressure within the cavity may also be controlled and regulated.

In a further advantageous embodiment of the inventive kitchen appliance, the kitchen appliance comprises a humidity sensor, capable of monitoring the humidity within the cavity, wherein, preferably said humidity sensor is connected to a control unit, capable of controlling the first valve and/or the second valve.

Such humidity sensor may advantageously monitor the actual humidity within the cavity and further may provide an according signal to the control unit of the appliance, which may be processed and evaluated such that a humidity level within the cavity may be adjusted to the desired needs, i.e. an operation of a steam generator may be regulated, e.g. started or stopped, and/or the first valve and/or the second valve may be controlled, e.g. changed in state from open to closed or vice versa. Accordingly, the humidity level within the cavity may be determined by such humidity sensor and advantageously controlled due to the information provided to the control unit of the appliance.

In a further advantageous embodiment of the inventive kitchen appliance, the outlet opening is arranged in an upper wall of the cavity.

This is of particular advantage in that the hot or warm air, steam and/or vapor accumulates in an upper region of said cavity due to physical laws of convection. Accordingly, an exhaust of steam and/or vapor, usually being warm or hot is facilitated when the outlet opening is arranged in such upper region, particularly in an upper wall of the cavity In a further advantageous embodiment of the inventive kitchen appliance, the inlet opening is arranged in a bottom wall and/or a sidewall of the cavity of the cavity, preferably a bottom wall.

Where the inlet opening is arranged in a sidewall it is preferred that said inlet opening is arranged in a lower region of said sidewall.

It is to be understood that terms such as "lower" or "upper" as used herein, preferably refer to the arrangement and positioning of a kitchen appliance in its usual and ready to use placement in a kitchen. Particularly, in some embodiments the present invention for the ease of understanding is described regarding a kitchen appliance, being an oven provided with a cooling chamber on top of its oven cavity. However, a person skilled in the art will immediately understand to adopt the present invention according to other configurations. For example, the cooling system, the ducts or the fans may be positioned adjacent to or on a sidewall or below or adjacent to a bottom wall of such appliance.

s Arranging the inlet opening in a bottom wall and/or a side wall, preferably a lower region of the side wall, of the cavity, more preferably in a bottom wall of the cavity is of particular advantage as the introduced air is colder than the vapor and/or steam within the cavity, particularly where the introduced air is air from the cooling system, or cooling chamber. According to physical laws of convection the hot or warm air, steam and/or vapor accumulates in an upper region of said cavity, whereas colder air will accumulate in a lower region of said cavity. Accordingly an absorption of a significant amount of humidity, as the overall humidity of the air, vapor and/steam within the cavity is reduced, is facilitated when the inlet opening is arranged in such bottom wall and/or side wall, preferably a lower region of the side wall, of the cavity, more preferably in a bottom wall of the cavity.

It will be understood that one major criteria for the positioning of the inlet opening is to provide a substantial and sufficient distance from the outlet opening. This is as the outlet opening advantageously functions as an overpressure exhaust in the oven cavity, for example in the cavity ceiling. Otherwise, a fluid dynamic short circuit could be generated, preventing proper flushing of the cavity volume.

In a further advantageous embodiment of the inventive kitchen appliance, the cooling system and/or the cooling chamber comprises a fan, preferably a radial or a tangential fan.

Such fan is of particular advantage in driving the air stream of said cooling and provoking a circulation of such cooling air stream and thus may contribute and assist an exhaustion of steam and/or vapor out of the cavity through the first duct, particularly, where the first duct is in fluid communication with the cooling system, preferably the cooling chamber; and/or the fan may contribute and assist an air influx into the cavity from a second duct, particularly where the second duct is in fluid communication with the cooling system, preferably the cooling chamber.

In a preferred embodiment, wherein the cooling system and/or the cooling chamber comprises a fan, preferably a radial or a tangential fan, said fan is the at least one first fan.

In a further advantageous embodiment of the inventive kitchen appliance, the first duct is arranged such that

- its first end is in fluid communication with the cavity at said outlet opening, and
- its second end is in fluid communication with said cooling system, preferably the cooling chamber.

This is of particular advantage in that said first duct is advantageously positioned such that the vapor and/or steam is exhausted directly out of said cavity and into the first duct, from where it enters the cooling system, preferably the cooling chamber and is mixed with the cooling air. The vapor and/or steam is than, preferably taken away by the cooling airflow.

In a further advantageous embodiment of the inventive kitchen appliance, the second duct is arranged such that

- its first end is in fluid communication with the cavity at said inlet opening, and
- its second end is in fluid communication with said cooling system, preferably the cooling chamber.

This is of particular advantage in that said second duct is advantageously positioned such that air from the cooling system, preferably a cooling chamber, is introduced into the second end of said second duct and thus the air may flowing into the cavity through the inlet opening at the first end of said second duct.

In a further advantageous embodiment of the inventive kitchen appliance, a second end of the first duct is arranged in an under pressure region of said cooling system, preferably of said cooling chamber, more preferably of said fan, preferably said at least one first fan.

This is of particular advantage in that said first duct is advantageously positioned in such under pressure region and due to an injector effect an under pressure within the first duct is generated and thus the vapor and/or steam is sucked from the cavity out of said cavity and into the first duct, from where it enters the cooling system, preferably the cooling chamber and is mixed with the cooling air. The vapor and/or steam is than, preferably taken away by the cooling airflow. In an advantageous embodiment of the inventive kitchen appliance said second end of the first duct is arranged in an under pressure region, being an outlet area of a fan, preferably such, that a rotating movement of said fan supports the sucking of the vapor and/or steam out of the cavity through said first duct.

The term "outlet area" as used herein, preferably refers to the positioning relative to a fan, accordingly, an outlet area is an area located in a region where air is blown to, whereas an inlet area refers to a region where air is pulled from.

It is immediately understood, that an under pressure region in general may be both, an inlet and/or an outlet area of the fan. Both is considered herein.

Where however, the second end of the first duct is arranged in an inlet area of the fan, the vapor, probably hot and moist, which is sucked out of the cavity has to pass the fan, which might be of disadvantage.

In both settings, however, it is preferred that a rotating movement of said fan generates such under pressure region and thus supports the sucking of the vapor and/or steam out of the cavity. This, preferably is the case if the second end and the respective opening of the first duct is designed and arranged such that the air blown or pulled by the fan strives said second end of the first duct and its respective opening and due to an injector effect an under pressure in the first duct is achieved and/or strengthened which supports the sucking of the vapor and/or steam out of the cavity. This particularly is of advantage in that the exhaustion of vapor and/or steam out of the cavity into the first duct, wherein said first duct is opened by a first valve, is supported.

In a further advantageous embodiment of the inventive kitchen appliance, a second end of the second duct is arranged in an over pressure region of said cooling system, preferably of said cooling chamber, more preferably of said fan, preferably said first fan.

This is of particular advantage in that said second duct is advantageously positioned such that air from the cooling system, preferably a cooling chamber, is pressed from such over pressure region into the second end of said second duct and thus the air may be pressed into the cavity through the inlet opening at the first end of said second duct. In an advantageous embodiment of the inventive kitchen appliance said second end of the second duct is arranged in such over pressure region being an outlet area of a fan, preferably such, that a rotating movement of said fan supports the influx of air into the cavity through said second duct.

It is immediately understood that in such configuration a rotating movement of said fan supports the influx of air into the cavity from said second duct.

In a further advantageous embodiment of the inventive kitchen appliance, in a state, wherein the first valve is arranged in a closed state and the second valve is arranged in a closed state steam and/or vapor within the cavity is preserved within the cavity, and/or

- in a state, wherein the first valve is arranged in an open state and the second valve is arranged in a closed state and wherein, preferably an overpressure of steam and/or vapor is within the cavity,
- steam and/or vapor exhausts out of the outlet opening, and/or
- in a state, wherein the first valve is arranged in an open state and the second valve is arranged in an open state steam and/or vapor within the cavity exhausts out of the outlet opening and is replaced and/or displaced by air, which enters the cavity by an air influx into the cavity from the second duct.

Accordingly, a cooking cycle performed within the kitchen appliance according to the present invention may be advantageously assisted and performed by the control of the states of the first valve and/or the second valve.

It is to be understood that according to the appliances of the prior art having only one exhaust valve said exhaust valve was in a closed state during a heating up phase, where steam is inserted into the oven cavity to reach a temperature setting and guarantee cooking performance and energy consumption; said exhaust valve is also in a closed state during a main cooking phase, where steam is preserved within the oven cavity to guarantee cooking performance and energy consumption; and that said exhaust valve is an opened state during a desteaming phase where oven cavity steam excess is released.

According to the kitchen appliance of the present invention, however, four phases are advantageously performed.

In a first phase, a heating up phase where steam is inserted into the oven cavity to reach a temperature setting and guarantee cooking performance and energy consumption the first valve and the second valve are both in a closed state; in a second phase, a main cooking phase, where steam is preserved within the oven cavity to guarantee cooking performance and energy consumption the first valve and the second valve are also both in a closed state; in a third phase, a desteaming phase where oven cavity over pressure is released, more particularly exhausted out of the cavity into a first duct, the first valve is in an opened state, whereas the second valve still is in a closed state; and in a fourth phase, a cavity flushing phase, where oven cavity steam excess is released, and more particularly an influx of air into the cavity from a second duct, provokes steam and/or vapor within the cavity to be further exhausted out of the outlet opening and being replaced and/or displaced by air, which enters the cavity by an air influx into the cavity from the second duct, both the first valve and the second valve are in an opened state.

In a further advantageous embodiment of the inventive kitchen appliance, the kitchen appliance is an oven, preferably a steam oven.

The kitchen appliance according to the present invention may be an oven or a cooking appliance of any kind. It will be understood that the inventive cavity flushing system can be advantageously be appliance to various kinds of kitchen appliances. It is however immediately understood that where the kitchen appliance is an oven, preferably a steam oven the inventive cavity flushing system is of particular advantage.

It is to be understood that the kitchen appliance according to the present invention preferably is designed as an open system meant to evacuate fumes, vapor and/or steam from the oven cavity and to replace them with fresh air.

In a preferred embodiment, the first duct and/or the second duct are configured as filter free ducts. In other words, no filters are foreseen neither for the intake nor for the outtake.

The kitchen appliance according to the present invention provides a system significantly simpler compared to systems known in the art, where the cavity exhaust, particularly the outlet opening for exhaustion of vapor and/or steam out of the cavity, is the only exit point for steam/vapor and humidity out of the cavity in all oven working conditions, preferably always conveying the fumes, vapor and/or steam flow to the main cooling air flow, particularly to the cooling system, preferably the cooling chamber. The first valve equipped on the exhaust, particularly the outlet opening preferably has the main purpose to enhance cavity saturation. The fresh air feed to the cavity preferably is achieved separately from the main cooling flow, more preferably exploiting as intake an over pressure area of a cooling fan, and avoiding the risk of fluid dynamic short circuits. The independence of the exhaust, particularly the outlet opening and the fresh air feed guarantee the possibility to operate independently, upon need, during the different phases of a cooking process.

In the kitchen appliance according to the present invention, preferably an overpressure generated by the rotation of a cooling fan is used to push air into the cavity through at least one inlet opening for influx of air into the cavity from a second duct, helping the exhaust flow instead of trying to invert the direction of it. This is greatly beneficial in terms of actual overpressure needed to achieve the flushing effect.

It is also to be understood that the kitchen appliance according to the present invention is flexible in terms of position of the intake of fresh air in the cavity, allowing by the way to use already existing openings for the purpose. In other words, an inlet opening may be arranged in any wall of the cavity, however a bottom wall and/or a side wall of the cavity of the cavity, preferably a bottom wall, is preferred.

It will be immediately understood that in the kitchen appliance according to the present invention preferably the cooling fan of the cooling system is used, which is, preferably arranged external to the cavity, to generate a flow of relatively fresh air into the cavity. This is particularly of advantage in that a further fan is not necessary, and the inventive system is independent from the presence of such further fan in the cavity, e.g. a fan for forced convection cooking, that is, anyway, for domestic ovens, a very simple and relatively inefficient component. Advantageously such cooling fan is, at least in built in appliances, a component ubiquitously applied, and its structure, is usually coupled with a sort of cochlea, implies the existence of the overpressure that can drive the fresh airflow in the cavity.

Preferably, according to the kitchen appliance according to the present invention the exhaustion of steam and/or vapor out of the cavity is performed not or not only by a sucking action during a de-steaming phase. More particularly, an overpressure is generated, preferably in the cochlea of a fan, which is the cooling fan meant to produce the sucking effect, and thus the overpressure is exploited by pushing actively air into the cavity, thereby greatly enhancing the overall system effectiveness.

All described embodiments of the invention have the advantage, that steam and/or vapor contained within a cavity is prevented from unwanted escape out of the cavity, particularly at the end of a cooking cycle and/or when a door is to be opened steam and/vapor is exhausted in a controlled manner such that upon an opening of the door no or a tolerable reduced amount of steam and/or vapor exhausts through the opened door. Additionally, the inventive kitchen appliance provides a more simple solution for proper cavity flushing with air, which is particularly effective.

The present invention will be described in further detail with reference to the drawings from which further features, embodiments and advantages may be taken, and in which FIG. 1, FIG. 2A and FIG. 2B illustrate perspective views of a kitchen appliance according to the present invention showing the first inventive embodiment;

Figure 1:
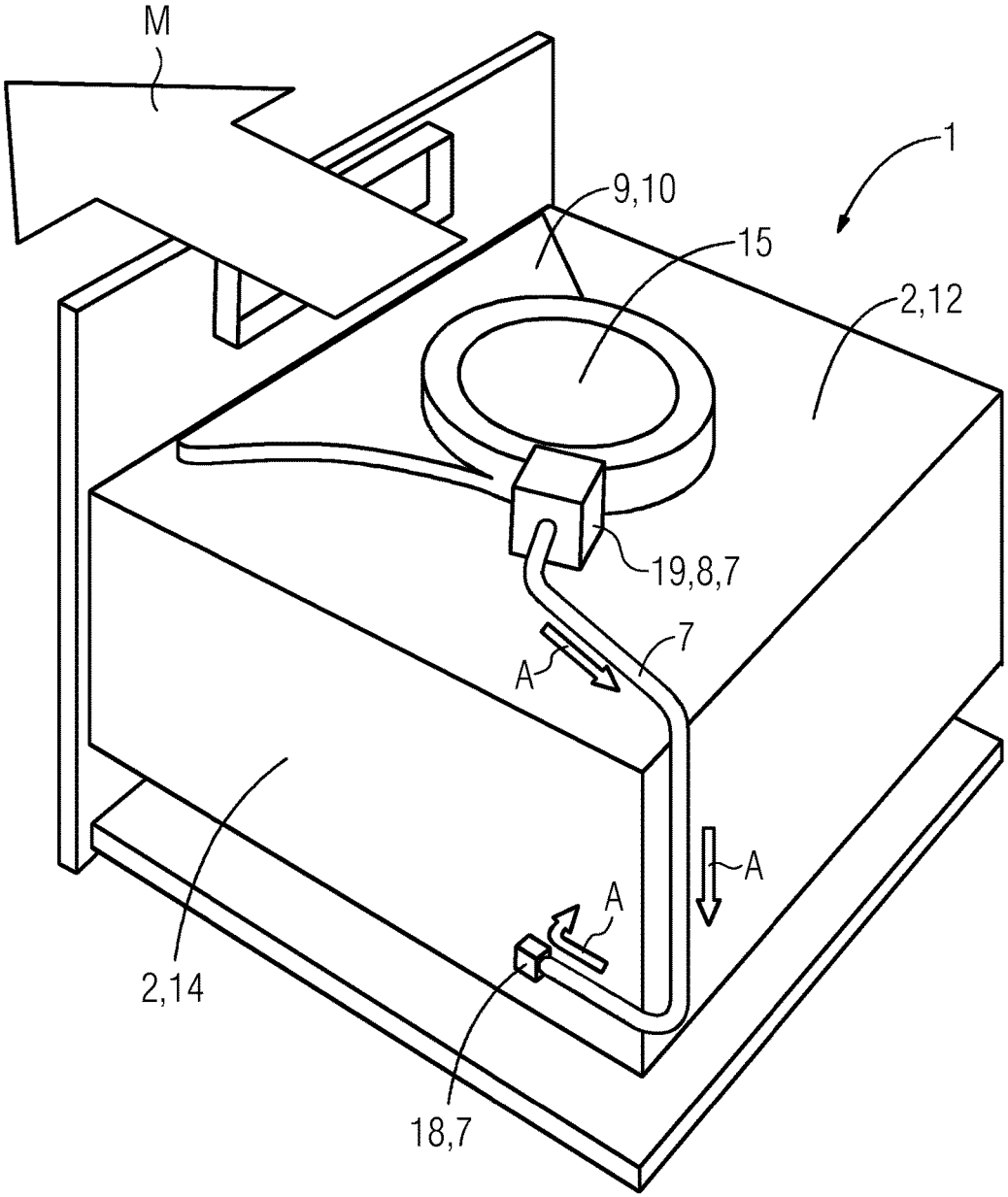
Figure 2A:
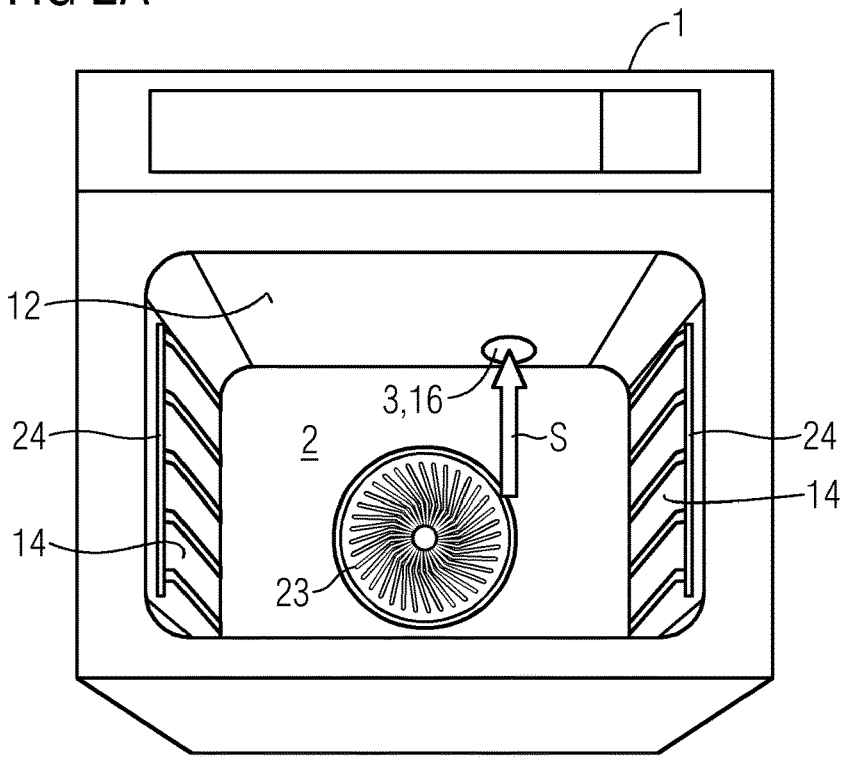
Figure 2B:
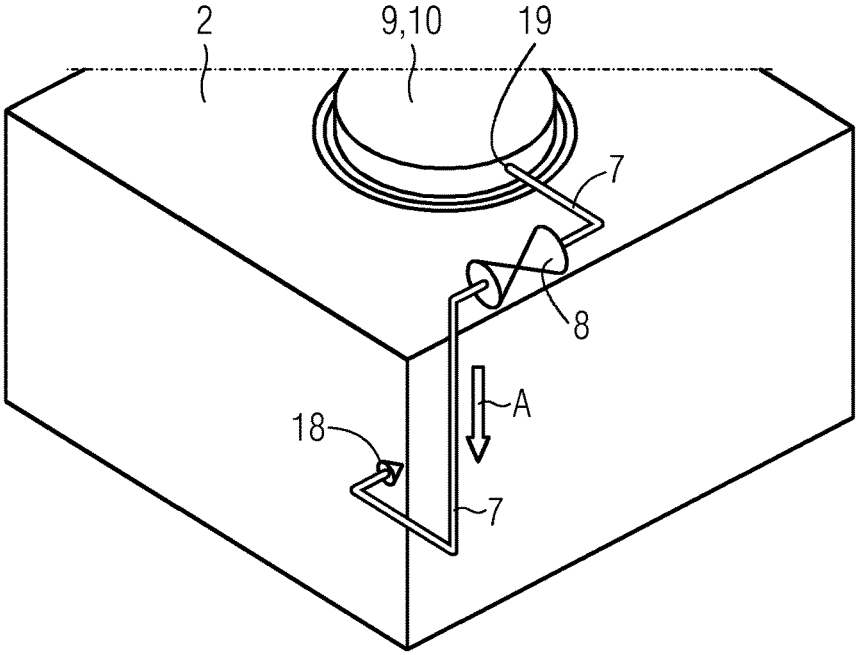

FIGS. 1, 2A and 2B show a kitchen appliance 1 according to a first inventive embodiment of the present invention, here a steam oven, which comprises a cavity 2, wherein said cavity 2 comprises at least one outlet opening 3 for exhaustion of vapor and/or steam out of the cavity 2 into a first duct 4, wherein said first duct 4 can be opened or closed by a first valve 5, and at least one inlet opening 6 for influx of air A into the cavity 2 from a second duct 7, wherein said second duct 7 can be opened or closed by a second valve 8. Advantageously said outlet opening 3 is positioned in an upper wall 12 of said cavity 2. The first valve 5 according to the first embodiment is not shown in the FIGS. 1, 2A and 2B, as it is preferably arranged within the first duct 4.

Figure 4A:
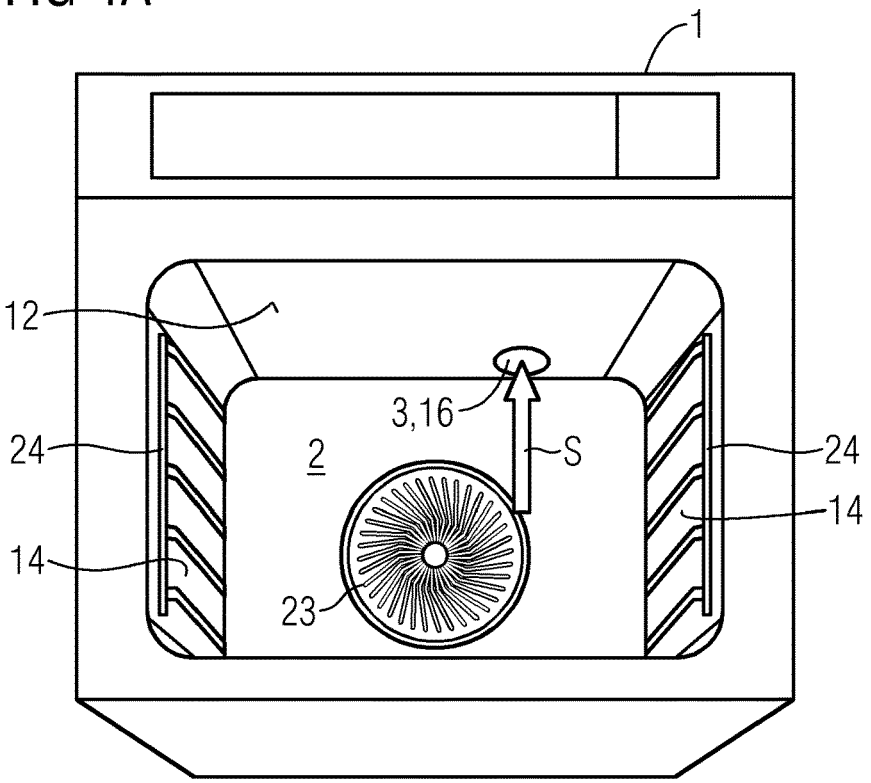
FIG. 4A and FIG. 4B illustrate perspective views of a kitchen appliance according to the present invention showing a second inventive embodiment.

As may be seen from FIG. 2A or 4A a further fan element 23 may be positioned within the cavity 2, being, for example, a central cooking fan 23 positioned in the back wall of the cavity 2.

Such additional fan element 23 may not be or at least not substantially be related with cooling. In the shown embodiment said further fan element 23 is a central cooking fan 23, meant to generate a forced convection inside the cavity 2, to enhance cooking process. The effect of such further fan element 23, particularly of such cooking fan 23, may not be for generating a flushing effect according to the present invention. However, a person skilled in the art will know to position the elements of the flushing system according to the present invention if such further elements, particularly such further fan element 23 is present. For example, the positioning and arrangement of an inlet opening 6 for flushing airflow advantageously may be selected such that negative interactions with the air or steam/vapor flow of such cooking fan 23 are avoided. For example, it may be of advantage to position and arrange an inlet opening 6 with sufficient distance to the areas where convection flow speed is high.

As may be also seen from FIG. 2A or 4A further the kitchen appliance 1 and, particularly the cavity 2 of such kitchen appliance 1 may comprise further elements generally known to the person skilled in the art. For example, side rails 24 may be provided in the cavity, particularly on an inner sidewall of the cavity in order to support a baking tray or grid.

Such steam oven 1 advantageously provides an enhanced steam exhaust system to ensure an improved steam evacuation from the oven cavity 2. A more effective removal/reduction of the steam and/or vapor S contained within the cavity 2 during a cooking cycle is enhanced and an exhaustion of the vapor and/or steam through an opened door is reduced. Moreover, steam and/or vapor S are more effectively be drained and exhausted from the appliance cavity 2, particularly when vapor and/or steam is in excess for the running cooking cycle.

Said second duct 7 can be opened or closed by a second valve 8, which can be opened or closed coordinated with said first valve 5, which is for opening or closing at least one outlet opening 3 for exhaustion of vapor and/or steam out of the cavity 2 into said first duct 4. Such exhaustion advantageously takes place if the vapor and/or steam in the cavity has an overpressure. The second valve 8 can be advantageously operated along with the first valve 5, to achieve a washing effect such that, preferably steam and/or vapor S within the cavity exhausts out of the outlet opening 3 and is replaced and/or displaced by air A, which enters the cavity 2 by an air A influx into the cavity 2 from the second duct 7. Thus, the steam and/or vapor S within the cavity is replaced and/or displaced.

Such washing and/or flushing preferably is mainly due to a psychrometric effect, i.e. by injecting a relatively small quantity of influx air A, preferably fresh air, more preferably relatively dry and/or cold fresh air, preferably ambient air. A person skilled in the art will immediately understand that this will affect air title inside the cavity 2 with a limited impact on temperature in the oven 1 and/or cavity 2. In connection therewith, it is to be understood that a more massive flushing flow would actually abate oven temperature, wasting at the same time energy, and temperature would have to be recovered.

Here, the steam oven 1 comprises a cooling system 9 comprising a cooling chamber 10. The cooling chamber 10 and the cooling system 9 are positioned on top of the upper cavity wall 12. The first duct 4 is in fluid communication with the cooling system 9, preferably the cooling chamber 10 and the second duct 7 is in fluid communication with the cooling system 9, more particularly, with the cooling chamber 10. Additionally, the first valve 5 and the second valve 8 both are configured as electric throttle valves, which allow a restriction and narrowing of the flux adjustable by said valve, and particularly allow for a targeted and selective control of different valve states, e.g. opened or closed, particularly by a not shown oven control unit. Such electronic valve is also advantageous in ensuring a proper opening/closing of the valves 5 and/or 8 and thus the regulation of an airflow A and/or steam and/or vapor flow S through the respective first duct 4 or second duct 7, respectively.

Moreover, it can be immediately seen that the cavity 2 and the cooling system 9 are configured as an open system, wherein the second valve 8 is operated along with the first valve 5 to achieve a "washing" effect of the cavity, i.e. a relatively small amount of relatively dry air A when introduced in the cavity 2 can absorb a significant amount of humidity, as it reduces the overall humidity title of the air A in the cavity 2. Furthermore, the cavity 2 is not designed as a strictly closed system, and a significant flow out of the exhaust can be achieved.

The steam oven 1 according to the shown embodiment comprises a not shown humidity sensor 11, capable of monitoring the humidity within the cavity 2, wherein, preferably said humidity sensor 11 is connected to an also not shown control unit, capable of controlling the first valve 5 and/or the second valve 8.

Figure 3:
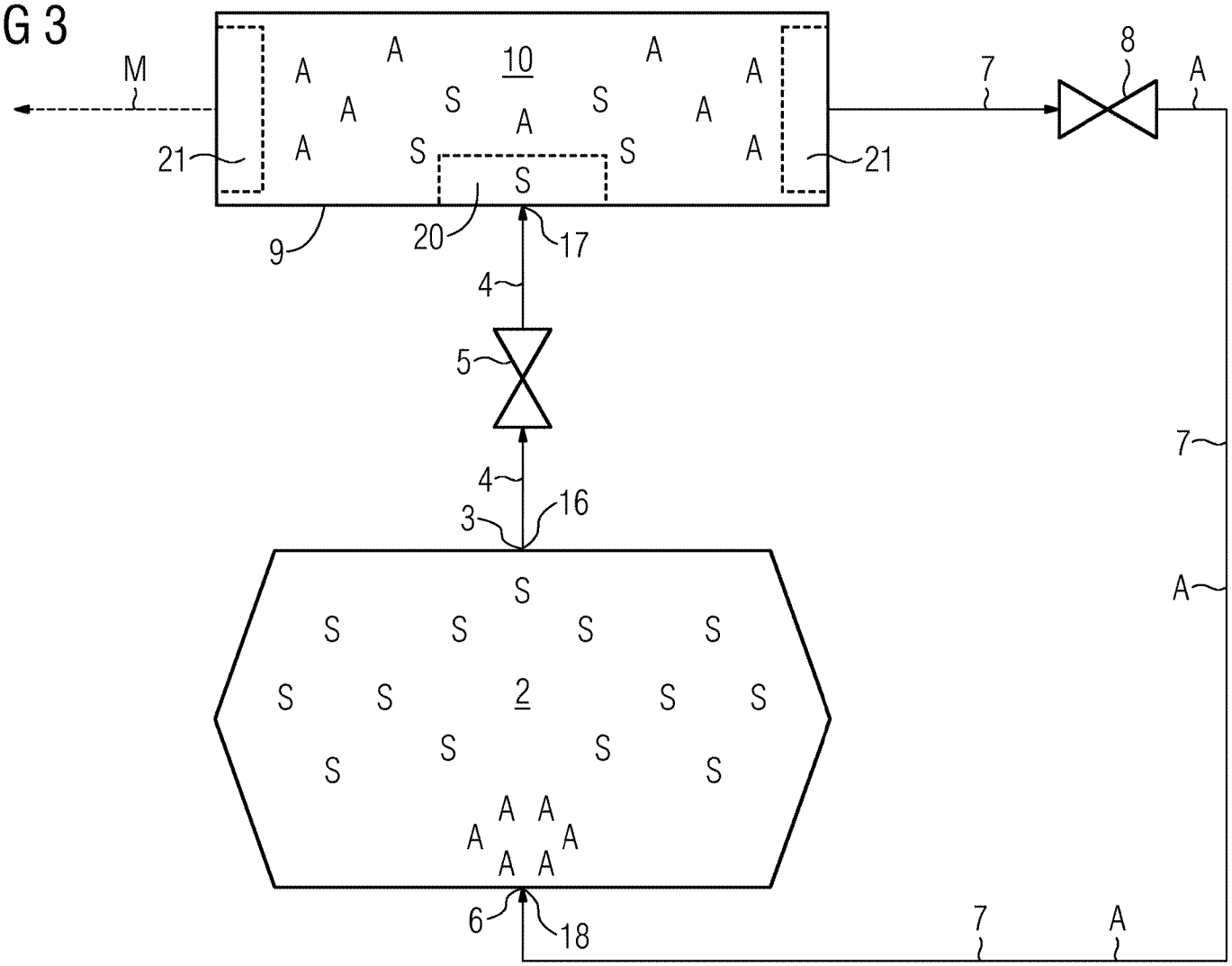
FIG. 3 illustrates a schematic diagram of a Humidity flushing system for a kitchen appliance according to the present invention showing the first inventive embodiment.

As may be taken from the schematic diagram of FIG. 3 and from FIG. 2A the outlet opening 3 may be arranged in an upper wall 12 of the cavity 2 and the inlet opening 6 may be arranged in a bottom wall 13 of the cavity 2.

This is of particular advantage in that the hot or warm air A, steam and/or vapor S accumulates in an upper region of said cavity 2 due to physical laws of convection. Accordingly, an exhaust of steam and/or vapor, usually being warm or hot is facilitated when the outlet opening 3 is arranged in such upper region, particularly in an upper wall 12 of the cavity 2 or an upper part of a sidewall 14 of the cavity 2, and additionally where the inlet opening 6 is arranged in a bottom wall 13 of the cavity 2 or a lower part of a side wall 14 of the cavity 2, this is of particular advantage as the introduced air A is colder than the vapor and/or steam S within the cavity 2, particularly as the introduced air A is air from the cooling system 9, or cooling chamber 10. For the positioning of the inlet opening 6 and/or the outlet opening 3 various configurations may be chosen. However, it is to be understood that a major criteria for the positioning of an inlet opening 6 and/or an outlet opening 3 is to provide a sufficient distance between the inlet opening 6 and the outlet opening 3, as otherwise a fluid dynamic short circuit could be generated, preventing proper flushing of the cavity volume.

The inventive steam oven 1, more particularly the cooling system 9 and the cooling chamber 10, comprises a first fan 15, preferably a radial or a tangential fan. As may be best seen from FIG. 1 and FIG. 2B the main cooling fan for driving the main cooling flow M may be advantageously used as said first fan 15. Such fan 15 preferably comprises a cochlea. In connection therewith, it is to be understood that a person skilled in the art will choose an advantageous positioning of such first fan 15. Such positioning is not per se crucial and can be chosen according to various needs, if such first fan 15 comprises and/or is surrounded by such cochleae housing, referred to herein as cochlea. Such cochlea is advantageously driving the main air output flow M, preferably used as cooling. Accordingly, any area or region within such cochlea will represent a high air pressure, which can be exploited to create a secondary air flow A entering the second duct 7, without significantly changing the main flow output M, provided that the flow rate of the secondary air flow A in the second duct 7 is significantly lower that the flow rate of the main cooling flow M.

Such first fan 15 is of particular advantage in driving the air A stream of said cooling and provoking a circulation of such cooling air A stream and thus may contribute and assist an exhaustion of steam and/or vapor S out of the cavity 2 through the first duct 4, particularly, where the first duct 4 is in fluid communication with the cooling system 9, preferably the cooling chamber 10; and/or the first fan 15 may contribute and assist an air A influx into the cavity 2 from a second duct 7, particularly where the second duct 7 is in fluid communication with the cooling system 9, preferably the cooling chamber 10.

However, it is to be understood that said first duct 4, particularly said first valve 5, is configured such that in an open stage of said first valve 5 said exhaustion of vapor and/or steam out of at least one outlet opening 3 of the cavity 2 into said first duct 4 is substantially due to an overpressure of vapor and/or steam S within said cavity 2, and that said second duct 7, particularly said second valve 8, is configured such that in an open state of said second valve 8 said influx of air A into at least one inlet opening 6 of the cavity 2 into said second duct 7 is substantially due to an overpressure of said air A generated in said second duct, particularly by said at least one first fan 15.

Here, the first duct 4 is arranged such that its first end 16 is in fluid communication with the cavity 2 at said outlet opening 3, and its second end 17 is in fluid communication with said cooling system 9, more particularly the cooling chamber 10, whereas the second duct 7 is arranged such that its first end 18 is in fluid communication with the cavity 2 at said inlet opening 6, and its second end 19 is in fluid communication with said cooling system 9, more particularly the cooling chamber 10. More particularly, the second end 17 of the first duct 4 is arranged in an under pressure region 20 of said cooling system 9, particularly of said cooling chamber 10 and of said first fan 15.

This is of particular advantage in that said first duct 4 is advantageously positioned in such under pressure region 20 and due to an injector effect an under pressure within the first duct 4 is generated and thus the vapor and/or steam S is sucked from the cavity 2 out of said cavity 2 and into the first duct 4, from where it enters the cooling system 9, more particularly the cooling chamber 10 and is mixed with the cooling air A. Such effect is supporting the exhaust substantially driven by the overpressure of steam/vapor S within the cavity. The vapor and/or steam S is than, preferably taken away by the cooling airflow A. Here the second end 17 of the first duct 4 is arranged in an under pressure region 20, being an outlet area of a first fan 15, such, that a rotating movement of said first fan 15 supports the sucking of the vapor and/or steam out of the cavity 2 through said first duct 4. The second end 19 of the second duct 7, however, is arranged in an over pressure region 21 of said cooling system 9, particularly of said cooling chamber 10, more particularly of said first fan 15.

This is of particular advantage in that said second duct 7 is advantageously positioned such that air A from the cooling system 9, particularly a cooling chamber 10, is pressed from such over pressure region 21 into the second end 19 of said second duct 7 and thus the air A is pressed into the cavity 2 through the inlet opening 6 at the first end 18 of said second duct 7. In an advantageous embodiment of the inventive steam oven 1 said second end 19 of the second duct 7 is arranged in such over pressure region 21 being an outlet area of a first fan 15, preferably such, that a rotating movement of said first fan 15 supports the influx of air A into the cavity 2 through said second duct 7.

In such configuration, a rotating movement of said first fan 15 supports the influx of air A into the cavity 2 from said second duct 7.

It is important to understand that in a state, wherein the first valve 5 is arranged in a closed state and the second valve 8 is arranged in a closed state steam and/or vapor S within the cavity 2 is preserved within the cavity 2, and in a state, wherein the first valve 5 is arranged in an open state and the second valve 8 is arranged in a closed state and wherein, an overpressure of steam and/or vapor S is within the cavity 2, steam and/or vapor S exhausts out of the outlet opening 3, and in a state, wherein the first valve 5 is arranged in an open state and the second valve 8 is arranged in an open state steam and/or vapor S within the cavity exhausts out of the outlet opening 3 and is replaced and/or displaced by air A, which enters the cavity 2 by an air influx A into the cavity 2 from the second duct 7.

Figure 4B:
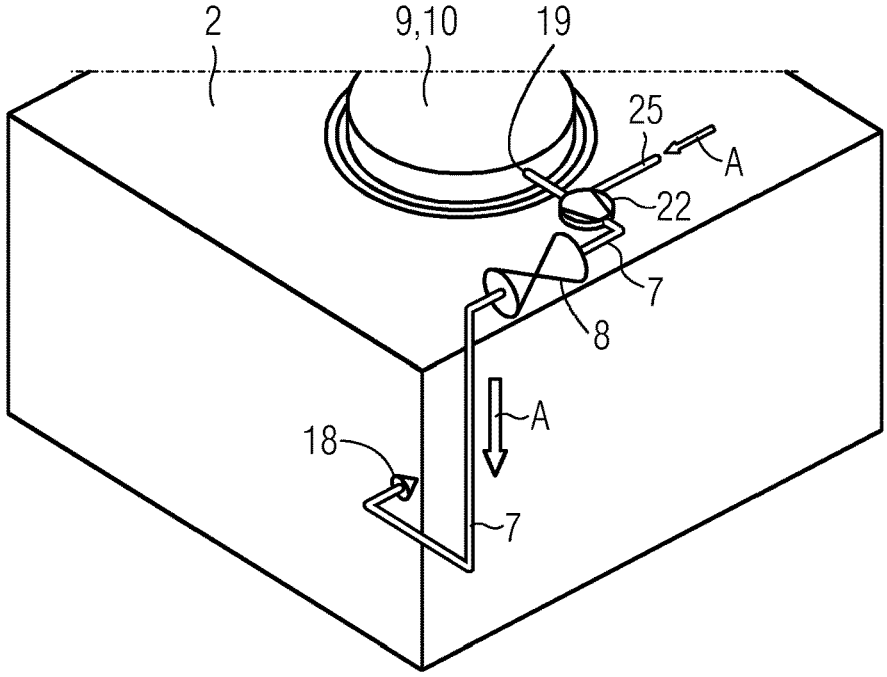
Figure 5:
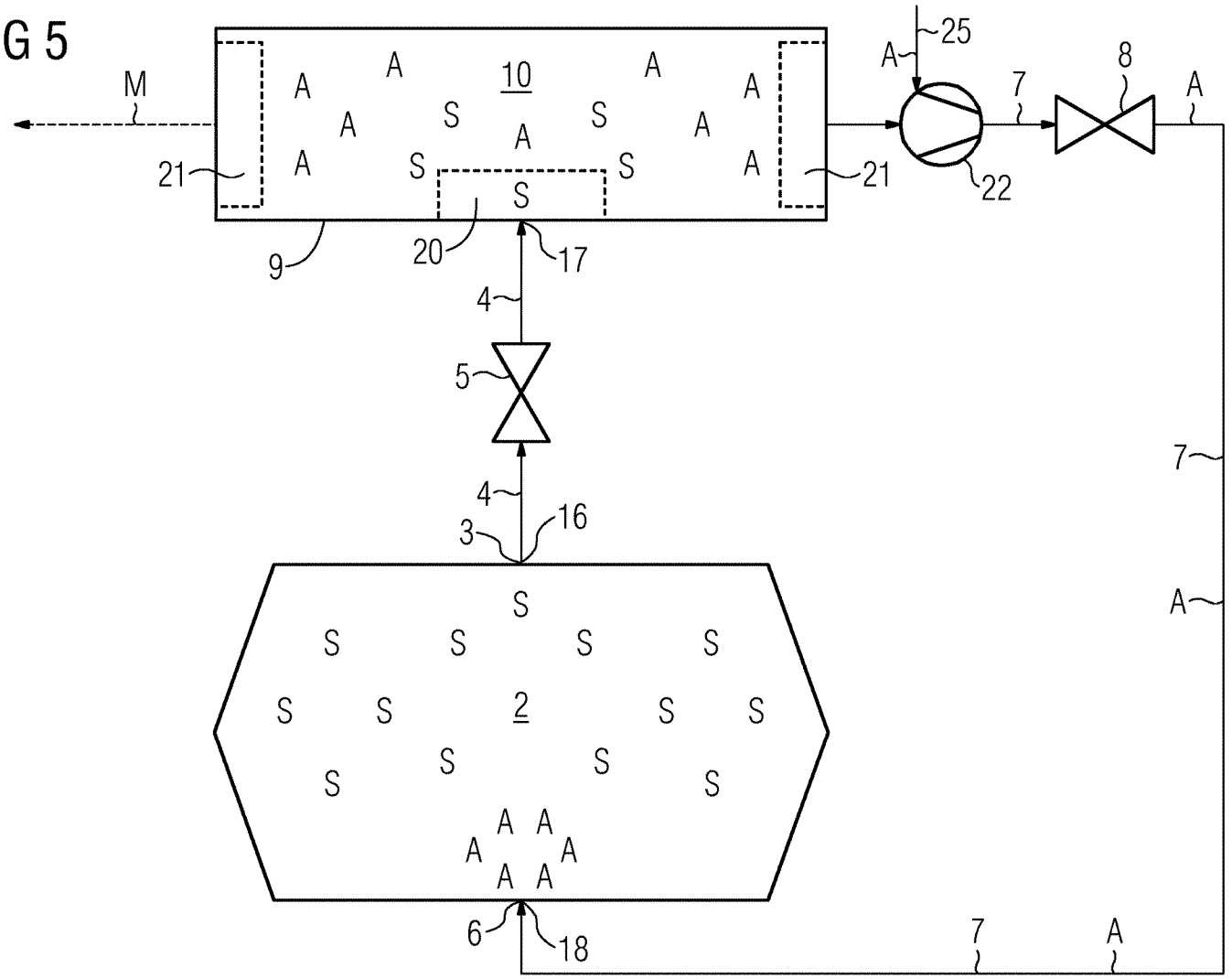
FIG. 5 illustrates a schematic diagram of a Humidity flushing system for a kitchen appliance according to the present invention showing the second inventive embodiment.

In FIGS. 4A and 4B, as well as in the schematic view of FIG. 5, a second embodiment of the kitchen appliance 1 according to the present invention is shown, which departs from the first embodiment, in that the kitchen appliance 1, particularly the flushing system of said kitchen appliance 1, comprises a second fan 22.

As may be immediately taken from FIG. 4B such second fan 22 advantageously is configured and positioned such that it generates and supports an overpressure of air in the second duct 7. According to the shown second embodiment of the appliance 1 according to the present invention, the second fan 22 is positioned close to or at a second end 19 of the second duct 17.

Accordingly, the influx of air into the inlet opening 6 of the cavity 2 from said second duct 7 is substantially due to an overpressure of said air generated in said second duct 7, preferably generated by said at least one first fan 15 and of said at least one second fan 22. Particularly, said second valve 8, is configured such that in an open state of said second valve said influx of air A into the inlet opening 6 of the cavity 2 from said second duct 7 is substantially due to an overpressure of said air A generated in said second duct 7, preferably generated by said at least one first fan 15 and by said at least one second fan 22.

Such second fan 22 may advantageously be placed in an overpressure region 21 of said first fan 15 in order to generate and assist the at least one first fan 15 in generating an overpressure of said air A in said second duct 7, particularly said influx of air A into the inlet opening 6 of the cavity 2 from said second duct 7.

In connection with providing such second fan 22 in addition to the at least one first fan 15, it is to be understood that said second fan 22 is provided additionally to the at least one first fan 15. In connection therewith, it is to be understood that the at least one first fan 15 may fulfill primarily the function of a main cooling fan, whereby the at least one second fan 22 is configured and/or positioned such that it substantially supports an overpressure in said second duct 7 generated by said first fan 15, whereby the influx of air A into the inlet opening 6 of the cavity 2 from said second duct 7 is advantageously supported by said at least one second fan 22.

As may be seen, for example from FIG. 4B, such second fan 22 according to the present invention may be arranged in direct fluid communication with the second duct 7. The second fan 22 may be arranged such that it is capable of generating an overpressure in the second duct 7, preferably alternatively or additionally to the overpressure generated by the first fan 15.

As shown in FIG. 4B such second fan 22 may be positioned in or connected to the second duct 7. The second fan 22 may be arranged in front of the second valve 8 with regard to the desired flow direction A in the second duct 7, which is depicted by the arrowheads of the respective arrows. However, the second fan 22 may alternatively be arranged subsequent to the second valve 8 with regard to the desired flow direction A in the second duct 7. This may be of particular advantage if it is desired to generate the overpressure in the second duct 7 by the second fan 22 only, particularly independent from the first fan 15. In such state, the second valve 8 may be closed, or at least partially closed, which would lower the contribution of the first fan 15 to the overpressure in the second duct 7. The first fan 15 may then fulfil its main purpose of generating and driving the main cooling flow M, whereby the second fan 22 may still generate an overpressure of airflow A in the second duct 7.

In an embodiment, the second fan 22 may comprise an air intake 25, e.g. an air intake duct 25, for sucking air into said second fan 22. Such air intake 25 may be configured to allow air intake A from outside of the cooling system alternatively or additionally to the air intake into such second fan from an overpressure region 21 of the first fan 15. Such air intake 25 may be regulated by an additional valve to be in an opened or closed state. Accordingly, the contribution of the second fan 22, as well as the sucking of air from an overpressure region 21 of the first fan 15, may be regulated by the operation, e.g. rotational speed, of said second fan 22, as well as additionally or alternatively by the regulation of the source of air intake, e.g. from the air intake 25 and/or from the from an overpressure region 21 of the first fan 15.

In both arrangements of the second fan 22, i.e. in front of or subsequent to the second valve 8, said second fan 22 preferably is arranged such that it is capable of generating a flow of air A in the second duct 7, e.g. on an external side of the cochlea of a main cooling fan 15. Preferably, the second fan 22 is arranged and/or positioned in direct connection with the second duct 7.

Such second fan 22 may thus advantageously enhance the flushing effect of the cavity 2 in "washing" phase. Furthermore, such second fan 22 advantageously prevents an undesired backflow of steam and/or vapor S into the second duct 7 and/or fluid dynamic short circuits.

In an embodiment, also the second fan 22 may advantageously comprise a cochlea. Furthermore, as may be seen from FIG. 4B such second fan 22, particularly a cochlea housing thereof, may comprise an additional duct for suction of fresh air A into the second fan 22, particularly into its housing. This advantageously allows the second fan 22 to suck fresh, preferably ambient, air A into the second duct 7. This is of particular advantage if the second fan 22 is positioned subsequent to a second valve 8, more particularly if said second valve 8 is in a closed state.

In an embodiment the first duct 4 and/or the second duct 7, comprises at least one further valve. For example, one second valve 8 may be positioned subsequent to the second fan 22, and one second valve 8 may be additionally positioned in front of said second fan 22.

As may be best seen from FIG. 4B such second fan 22 is configured smaller than the first fan 15. Such smaller configuration of the second fan 22 compared to the first fan 15 is advantageous as it may be easily arranged and/or placed within the flushing system, according to the present invention, preferably close to or as part of the second duct 7, more preferably at a second end 19 of the second duct 7.

From FIG. 5 it is also immediately apparent that an overpressure is generated in the second duct 7, particularly in an area of the second valve 8 and/or where the second valve 8 input spills the air A to be driven into the cavity 2. Such overpressure area may be located close to a high-pressure area or over pressure region 21 of the first fan 15 and/or of the second fan 22, e.g. the high-pressure area of a cooling radial fan cochlea, and/or at a second end 19 of the second duct 7.

The features of the present invention disclosed in the specification, the claims, and/or the figures may both, separately and in any combination thereof, be material for realizing the invention in various forms thereof.

LIST OF REFERENCE NUMERALS

1 kitchen appliance
2 cavity
3 outlet opening
4 first duct
5 first valve
6 inlet opening
7 second duct
8 second valve
9 cooling system
10 cooling chamber
11 humidity sensor
12 upper wall of the cavity
13 bottom wall of the cavity
14 side wall of the cavity
15 first fan
16 first end of first duct
17 second end of first duct
18 first end of second duct
19 second end of second duct
20 under pressure region
21 over pressure region
22 second auxiliary fan
23 fan element inside cavity
24 side rails
25 air intake
S steam and/or vapor
A fresh air/cavity flushing flow
M main cooling flow

The invention claimed is:

1. A kitchen appliance comprising at least one first fan, a cavity, and a cooling system, wherein said cavity comprises at least one outlet opening for exhaustion of vapor and/or steam out of the cavity into a first duct, wherein said first duct can be opened or closed by a first valve, and at least one inlet opening for influx of air into the cavity from a second duct, wherein said second duct can be opened or closed by a second valve, wherein said first duct and said first valve are configured such that in an open state of said first valve said exhaustion of vapor and/or steam out of the at least one outlet opening of the cavity into said first duct is substantially due to an overpressure of vapor and/or steam within said cavity, and wherein said second duct and said second valve are configured such that in an open state of said second valve said influx of air into the at least one inlet opening of the cavity from said second duct is substantially due to an overpressure of said air generated in said second duct, wherein the first duct is in fluid communication with the cooling system.

2. The kitchen appliance according to claim 1, wherein the second duct is in fluid communication with the cooling system.

3. The kitchen appliance according to claim 1, wherein the first valve and/or the second valve is a throttle valve.

4. The kitchen appliance according to claim 1, wherein the cavity and the cooling system are configured as an open system.

5. The kitchen appliance according to claim 1, wherein the first valve and/or the second valve is an electric valve.

6. The kitchen appliance according to claim 1, wherein the kitchen appliance comprises a humidity sensor capable of monitoring the humidity within the cavity, wherein said humidity sensor is connected to a control unit capable of controlling the first valve and/or the second valve.

7. The kitchen appliance according to claim 1, wherein the at least one outlet opening is arranged in an upper wall of the cavity.

8. The kitchen appliance according to claim 1, wherein the at least one inlet opening is arranged in a bottom wall and/or a side wall of the cavity.

9. The kitchen appliance according to claim 1, wherein the cooling system comprises said first fan.

10. The kitchen appliance according to claim 1, wherein the first duct is arranged such that its first end is in fluid communication with the cavity at said at least one outlet opening, and its second end is in fluid communication with said cooling system, and/or wherein the second duct is arranged such that its first end is in fluid communication with the cavity at said at least one inlet opening, and its second end is in fluid communication with said cooling system.

11. The kitchen appliance according to claim 1, wherein a second end of the first duct is arranged in an under pressure region of said cooling system.

12. The kitchen appliance according to claim 1, wherein a second end of the second duct is arranged in an over pressure region of said cooling system.

13. The kitchen appliance according to claim 1, the kitchen appliance comprising at least one second fan.

14. The kitchen appliance according to claim 1, wherein in a state wherein the first valve is arranged in a closed state and the second valve is arranged in a closed state steam and/or vapor within the cavity is preserved within the cavity, and/or in a state wherein the first valve is arranged in an open state and the second valve is arranged in a closed state steam and/or vapor exhausts out of the outlet opening, and/or in a state wherein the first valve is arranged in an open state and the second valve is arranged in an open state steam and/or vapor within the cavity exhausts out of the at least one outlet opening and is replaced and/or displaced by air, which enters the cavity by an air influx into the cavity from the second duct.

15. The kitchen appliance according to claim 1, said overpressure of said air generated in said second duct being produced by said at least one first fan.

16. The kitchen appliance according to claim 9, said cooling system comprising a cooling chamber, said first fan being arranged in said cooling chamber.

17. The kitchen appliance according to claim 12, said cooling system comprising a cooling chamber, said first fan being arranged in said cooling chamber, wherein the second end of the second duct is arranged in an over pressure region of said first fan.

18. A kitchen appliance comprising a cooking cavity and a cooling chamber, the cooking cavity having an outlet opening in an upper wall thereof and an inlet opening in another wall thereof, said outlet opening being in fluid communication with an underpressure region of said cooling chamber via a first flow path having a first valve and said inlet opening being in fluid communication with an overpressure region of said cooling chamber via a second flow path having a second valve, said second flow path having a smaller cross-section than said first flow path, a cooling fan disposed in said cooling chamber and effective to generate an underpressure in said underpressure region and an overpressure in said overpressure region, said cooling fan being further effective to generate a flow of cooling air for the appliance, a controller operatively coupled to each of said first and second valves and configured to operate them so that:

in a first mode the first valve is opened and the second valve is closed thus allowing pressurized steam and/or vapor in said cooking cavity to be exhausted therefrom into said cooling chamber;

in a second mode both the first and second valves are closed thereby maintaining in said cooking cavity the steam and/or vapor therein; and in a third mode both the first and second valves are opened thereby flushing said cooking cavity by exhausting steam and/or vapor therefrom into said cooling chamber where the steam and/or vapor will be mixed with said flow of cooling air, and introducing dryer and/or cooler air, relative to said steam and/or vapor, into said cooking cavity via said inlet opening.

19. The kitchen appliance of claim 18, further comprising a second fan, smaller than said cooling fan, in fluid communication with said second flow path and effective to generate or support overpressure therein, and an air intake coupled to said second fan configured to permit said second fan to draw outside air from outside said cooling system in order to generate or support said overpressure in said second air flow path, said controller being configured to operate said appliance according to a cooking cycle comprising a plurality of phases corresponding to said first, second and third modes.

20. The kitchen appliance according to claim 1, wherein the influx of air into the cavity from the second duct causes an overpressure within the cavity resulting in exhaustion of vapor and/or steam out of the cavity through the outlet opening into the first duct.

21. The kitchen appliance according to claim 18, wherein an influx of air into the cavity from the inlet opening causes an overpressure within the cavity resulting in exhaustion of vapor and/or steam out of the cavity through the outlet opening.

* * * * *